United States Patent [19]

Foreman et al.

[11] 4,158,579

[45] Jun. 19, 1979

[54] METHOD FOR RECYCLING HEAT TREATING SALTS

[75] Inventors: Robert W. Foreman, Bloomfield Hills; Gajen P. Dubal, Sterling Heights, both of Mich.

[73] Assignee: Park Chemical Company, Detroit, Mich.

[21] Appl. No.: 852,981

[22] Filed: Nov. 18, 1977

Related U.S. Application Data

[63] Continuation-in-part of Ser. No. 670,152, Mar. 25, 1976, abandoned.

[51] Int. Cl.[2] ..... C21D 1/46

[52] U.S. Cl. ..... 148/20; 148/15; 423/399

[58] Field of Search ..... 148/15, 15.5, 20, 27; 252/71; 423/399

[56] References Cited

U.S. PATENT DOCUMENTS

| | | | |
|---|---|---|---|
| 3,793,208 | 2/1974 | Foreman | 252/71 |
| 3,847,597 | 11/1974 | Mueller et al. | 148/15.5 |
| 3,953,248 | 4/1976 | Coch | 162/28 |
| 3,966,508 | 6/1976 | Mohr | 148/15 |

*Primary Examiner*—Arthur J. Steiner

*Attorney, Agent, or Firm*—Krass & Young

[57] ABSTRACT

A system for recycling heat treating salts such as nitrates and nitrites from a rinse bath including means to prevent the excessive build-up of impurities such as carbonates or chlorides which impair heat treat efficiency. For example, carbonates which form in a nitrate-nitrite quench bath and chlorides which are carried by drag-out into a nitrate-nitrite quench bath from a chloride heat treating bath are removed by concentrating the rinse water, removing undesirable components from the concentrate and returning molten rectified salt to the quench.

18 Claims, 1 Drawing Figure

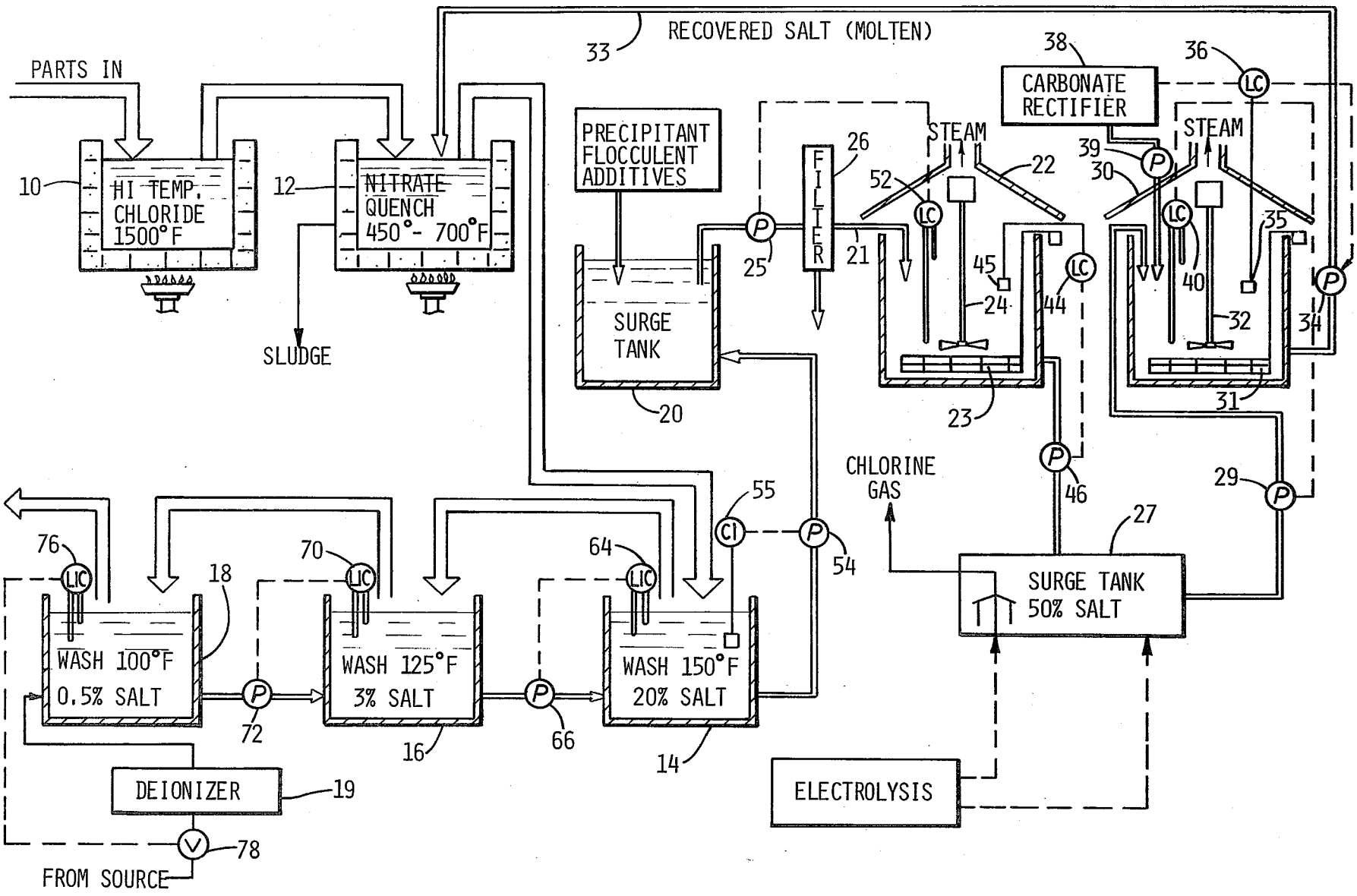
RECOVERED SALT (MOLTEN)
STEAM
STEAM
CARBONATE RECTIFIER
SURGE TANK 50% SALT
CHLORINE GAS
ELECTROLYSIS
FILTER
PRECIPITANT FLOCCULENT ADDITIVES
SURGE TANK
WASH 150°F 20% SALT
WASH 125°F 3% SALT
WASH 100°F 0.5% SALT
NITRATE QUENCH 450°- 700°F
HI TEMP. CHLORIDE 1500°F
SLUDGE
PARTS IN
DEIONIZER
FROM SOURCE

METHOD FOR RECYCLING HEAT TREATING SALTS

REFERENCE TO RELATED APPLICATIONS

This application is a continuation in part of application Ser. No. 670,152, filed Mar. 25, 1976, entitled "Method and Apparatus for Recycling Heat Treating Salts", now abandoned.

INTRODUCTION

This invention relates to methods and apparatus for recycling water soluble heat treating salts from a rinse bath into which the salts are introduced by drag-out from a heat treating bath. In particular, the invention relates to the effective prevention of the build-up of impurities and undesirable reaction products such as chlorides and carbonates in the heat treating bath due to the salt recycling.

As used herein the term "heat treating" refers to processes such as heating and quenching for the purpose of altering physical characteristics of a metal, and excludes material deposition processes such as electroplating.

BACKGROUND OF THE INVENTION

Commercial hardening techniques for ferrous metal components typically involve the steps of heating the components in a furnace or a bath of molten salt, such as a chloride, quenching the components in a bath of another molten salt such as a nitrate, nitrite, or mixture thereof, and thereafter causing the parts to be passed through one or more rinse baths to clean off salts which cling to the parts as a result of the heating and quenching steps. A certain amount of each of the molten salts is transferred by drag-out to the rinse bath, thus requiring occasional replenishment of the molten salts, as well as replacement of the rinse water.

It is desirable to recover the salts from the rinse water and return them to the heat treating baths. However, a number of problems have heretofore prevented such recycling on an efficient and economical basis. First, it is difficult to justify economically the installation of recovery apparatus unless the quantities of reclaimed salts are very high, and the recovery process can be carried out without shut-down of the heat treating system. Secondly, it has been found that the impurities which typically find their way into heat treating baths tend to build up to unacceptable levels particularly fast when the salts are recovered from the rinse and recycled into the heat treat bath. For example, chloride salts from a heating bath are dragged into the quench bath and thence into the rinse where recycling tends to return them to the quench bath. Recycled chloride impurities quickly reach insolubility levels in the quench, and crystallize out as a sludge which must be removed from time to time. In addition, chloride tends to substantially reduce the quench efficiency of a nitrate/nitrite bath and, thus, removing the chlorides is highly desirable.

Another impurity which will build up quickly as a result of salt recycling is carbonate, a reaction product of decomposition of the salt itself. For example, a sodium nitrate/nitrite salt tends to form $Na_2CO_3$, the carbonate coming from the $CO_2$ present in the air. The sodium carbonate is quite soluble in the rinse water but only sparingly soluble in the nitrate/nitrite quench bath and, thus forms a precipitate in the bath which impairs quenching efficiency and coats mechanical components in contact with the bath.

It should be understood that both the chloride and carbonate impurities, as well as many other impurities such as hard water ions, are typically present in the heat treating salt baths of prior art systems. However, the levels of concentration of such impurities are kept reasonably and acceptably low for longer periods of use by reason of the fact that impurities as well as desirable salts are continuously lost by drag-out. Lost salt, of course, is replaced by fresh salt which does not contain the impurities. Where salt is recycled, however, undesirable impurities dragged into the rinse and which are soluble in the rinse water are retained in the recycled materials and, after a short time, reach unacceptable concentrations.

SUMMARY OF THE INVENTION

The present invention provides a method for recycling water soluble heat treating salts, typically by reclaiming such salts from a rinse bath and returning them to the heat treating bath in such form as to prevent the build-up of undesirable impurities such as carbonates and chlorides and reaction products from decomposition of the original heat treating salts. Moreover, the invention provides for such recycling in an economical and practical fashion.

In general, the method of recycling the water soluble heat treating salt from a rinse bath into which the salt has been introduced by drag-out from a molten salt heat treating bath comprises the steps of concentrating the rinse water with the impurities therein, treating the concentrated solution to remove the impurities, removing the remaining water, and treating the molten salt further, and returning the salt to the heat treating bath, all of such steps being performed on the salt in a liquid state, either because it is in solution or molten.

The invention is set forth hereinafter with reference to specific examples, the first of which involves a substantially automatic and continuous process and apparatus for recycling nitrate/nitrite salts for use in a quenching bath, and particularly for the removal of carbonates which are formed as a product of reaction with carbon dioxide in the air. In the preferred form the treatment for removal of the carbonate involves nitric acid rectification performed on a molten salt under closely controlled conditions of temperature and chemical composition.

The invention as well as the various additional features and advantages thereof will be best understood from a reading of the following specification which describes the best known mode of practicing the invention and is to be taken with the accompanying drawing.

DESCRIPTION OF THE DRAWING

The single FIGURE is a schematic diagram of a system embodying the invention for automatically recycling nitrate/nitrite salts from a rinse tank to a molten quenching bath by counterflow and evaporative concentration, and acidic rectification to remove carbonate impurities.

DETAILED DESCRIPTION

The drawing shows a typical heat treating arrangement for hardening ferrous metal parts, and a specific, illustrative embodiment of the invention as applied to the recovery and recycling of nitrate/nitrite salts from a quench bath. In the drawing the parts are heated by immersion in a molten chloride contained in a gas-fired refractory furnace 10. It will be understood that the furnace 10 could also be an atmospheric furnace as far as the effect of heat treatment is concerned. After heating to approximately 1500° F. in the chloride bath, the parts are transferred to a refractory quench furnace 12 containing a bath of molten salt such as a sodium nitrate/nitrite mixture maintained in a molten condition at a temperature of about 450° F. to about 700° F. Furnace 12 is also typically gas-fired. The metallurgical result of heating and quenching ferrous metal parts is well known and will not be described herein.

From the quench bath 12 the parts are removed to an open rinse tank 14 containing water at approximately 150° F. for the purpose of rinsing off salts which are dragged from the quench bath 12 by the parts under treatment as well as the carrier apparatus for the parts. Typically, the quench bath and the rinse tank are located in close physical proximity to one another such that a substantial portion of the molten salt dragged out of the bath 12 on the parts finds its way to the rinse tank 14. The parts thereafter may go through a sequence of additional interconnected open rinse tanks 16 and 18 containing water at temperatures of 125° F. and 100° F., respectively, where substantially all the remaining salts clinging to the parts and carriers are washed away. The sequential rinse results in gradually decreasing salt content in the rinse water of baths 14, 16, and 18 and is indicated in the drawing.

It can be seen that some quantity of chloride salt from the heating furnace 10 is dragged into the nitrate-nitrite salt quench bath where it is regarded as an impurity. The chloride, and other impurities, are removed to the rinse tank 14 by drag-out and are dissolved in the rinse water along with the nitrate/nitrite salts which are to be recovered.

The first step in the recovery process involves concentrating the rinse water. This is accomplished in two ways. First, a countercurrent flow system is connected between rinse tanks 14, 16 and 18 such that the highest concentration of recoverable salt exists in tank 14. Fresh water enters tank 18 through a de-ionizer 19. Tank 18 overflows into tank 16 which, in turn overflows into tank 14. It will be understood that the term "overflows" is not necessarily to be construed literally for, although a system of weirs and gravity flow channels can be used, the illustrated embodiment employs electronic detectors and controlled pumps as hereinafter described.

As the level in tank 14 drops because solution is pumped out on automatic control, the lower of two sensor probes senses that the level in the tank has reached its position. This then registers on the Level Indicator/Controller (LIC) 64 and actuates the pump 66 to refill the tank up to the second or higher probe at which point the LIC 64 will shut off pump 66. As a result of this, the level in tank 16 will drop. The Level Indicator/Controller 70 in tank 16 will then refill that tank from tank 18. Tank 18 in turn will be filled when its Level Indicator/Controller 76 opens valve 78.

After achieving a recoverable salt concentration in tank 14 of about twenty percent, the solution is transferred from tank 14 to a surge tank 20 which is preferably closed and of a capacity larger than that of the rinse tank 14.

The appropriate time to make the transfer is determined automatically. A Concentration Indicator (CI) 55 detects when the salt concentration has reached 20% in the bath, and at that point starts pump 54. As fresh water comes into the tank, the concentration decreases; it is sensed by the Concentration Indicator 55 and the pump 54 is shut off. The Concentration Indicator 55 may use any one of several different means of detecting concentrations. It could be a gravitometer, a conductivity detector, or a refractive index indicator or some other means. From surge tank 20, the rinse water salt/impurity solution is transferred through a fluid circuit 21 to a hooded concentrator 22 automatically for further concentration by evaporation of the rinse water. Concentrator 22 also works under an automatic control scheme. The Concentration Indicator 45 and/or a level controller or a temperature indicator is inserted into the tank 22. After a charge of rinse water at 20% concentration is received into the evaporator 22 the solution is heated. At some point the indicator 45 will indicate that a 50% concentration has been achieved. This may be done in one of several ways. Either there may be a Concentration Indicator similar to the one in tank 14 which will detect a 50% concentration; or there can be a level indicator which is placed, such that, as the appropriate amount of water is evaporated from a 20% solution to make a 50% solution, the indicator will be actuated; or a temperature indicator might be used which would be actuated as the liquid in the evaporator 22 reached the boiling point of a 50% salt solution. The level control 44 then actuates the pump 46 to empty out the evaporator 22 into the surge tank 27. As the level reaches the lower probe of level controller 52 the pump 25 would be actuated to refill the evaporator 22. As the upper level probe was reached by the solution, the pump 25 would be shut off. An over-the-side electric immersion heater 23 and an air motor driven agitator 24 are employed to effect the evaporation in evaporator 22. Fluid circuit 21 comprises, in addition to conduit of a suitable non-corrosive material such as Inconel, a pump 25 and a filter 26 which removes loose foreign matter such as scale.

After achieving the 50% concentration in unit 22, the solution is transferred into a second, closed surge tank 27 of a capacity about three to four times that of the unit 22. From surge tank 27, the 50% solution is transferred through fluid circuit 28 containing pump 29 to a hooded melter unit 30 which is similar to unit 22 but which operates at a higher temperature for reasons to be described. Melter unit 30 comprises an electric immersion heater 31 and an air motor driven agitator 32 to maintain uniform temperature throughout the contents thereof.

Melter unit 30 is controlled in a similar fashion to the evaporator 22. On the inlet the control is the same. As the melter unit 30 empties, the lower level probe senses this and the level control 40 starts pump 29 to fill the melter unit. As the liquid level reaches the upper level sensor 40, it shuts down the pump 29. A sensor 35, which may be a level indicator, or a concentration indicator or a temperature indicator that differs from the indicator 49 in the evaporator only in that it is actuated when the salt achieves a molten or anhydrous state. The indicator 35 would then either actuate the controller 36 to start the pump 34 to empty the melter unit 30 into the nitrate quench bath 12, or the indicator 35 would actuate a timer-controller 36 to carry out the rectification procedure. The rectification procedure is controlled by a sequence timer, contained in the controller 36. The sequence timer starts the pump 39 to add the desired amount of rectifier solution from the holding tank 38 to the melter 30. The sequence timer then allows a period for reaction and mixing in melter 30 before activating pump 34 to pump the molten rectified salt through fluid circuit 33 to the nitrate quench bath 12.

Preferred liquid level detectors are of the fixed electrode floatless type available from B/W Controls, Inc. of 2200 East Maple Road, Birmingham, Michigan 48013. Both the liquid level detectors and the accompanying solid state control circuits are standard products of B/W Controls, Inc. and are commercially available at the present time. Similarly, pumps, alarms, and other electronic components are commercially available from a variety of sources as will be apparent to those skilled in the art. Suitable immersion heaters are available from General Electric Company; a 370 kw heater with temperature control and high temperature cut-off is suggested, although the melter may operate with a 200 kw heater having an SCR temperature control, high temperature and level cut-off and an audio visual signal.

EXAMPLE I—NITRATE RECOVERY WITH CARBONATE IMPURITY REMOVAL

In the first specific example of operation, it will be assumed that the salt to be recovered is sodium nitrate, it being understood that the typical quench bath utilizes a mixture of potassium nitrate and sodium nitrite. It should further be understood that sodium nitrate is merely representative of the salts which may be used in commercial heat treating baths; other salts are potassium nitrate, potassium nitrite, lithium nitrate, lithium nitrite, magnesium nitrate, strontium nitrate and others. It will be further assumed that the principal impurity to be removed from the salt before recycling is sodium carbonate, formed as a product of salt decomposition wherein the carbonate is derived from carbon dioxide in the air. As will be appreciated by those skilled in the art, air in the vicinity of high temperature heat treating operations is typically rich in $CO_2$.

Sodium carbonate ($Na_2CO_3$) is formed in the quench bath 12 where it is only sparingly soluble. Once the concentration of carbonate exceeds the level of solubility in bath 12, the carbonate not only substantially interferes with quench efficiency, but clings to and coats the apparatus associated with the bath. A substantial operating improvement can be realized by removing the carbonate from the salt which is recovered from the rinse and recycled back to the quench.

The preferred treatment for effective removal of carbonates is known as rectification and is preferably performed in the melter unit 30 after the concentrate has reached a uniform temperature of about 400° F. and all water has been driven off. The indicator 35 indicates the temperature and through controller 36 actuates a timed sequence of rectification and pump out of melter 30.

Rectification is achieved by introducing into the concentrate an aqueous solution consisting of about 0.1 percent to about eight percent by weight free nitric acid, about 0.01 percent to about five percent by weight a non-ionic surfactant for deterring foaming and for assisting in rapid dispersion of the nitric acid solution in the bath, and the balance water. The temperature of the concentrate must be maintained in the range of about 300° F. to about 600° F. during the rectification process. This treatment has been found to provide good results in rectifying the concentrate, the reaction products being sodium nitrate and carbon dioxide which dissipates as a gas.

The nitric acid content of the aqueous solution referred to above should preferably be maintained within the range of two percent to about seven percent and best results are obtained within the range of about four percent to about six percent free nitric acid by weight of said aqueous solution. The surfactant used in the treatment should be non-ionic, low foaming and soluble in water and stable to dilute aqueous acids such as nitric acid. The surfactant should preferably not contain undesirable components that would contaminate the baths. Undesirable components would be metallic ions other than those already in the system or anions such as phosphates or sulfates which would combine to form insoluble precipitates upon decomposition of the surfactant. Satisfactory surfactants for rectification purposes are available from Wyandotte Chemical Company and may be described as propylene oxide/ethylene oxide block copolymers. The Wyandotte Chemical Company trade name is Pluronic F68LF. Other acceptable agents are available from: GAF Corporation under the trade name Igepal CO 610; Olin Corporation under the trade name Poly-Tergent LF-405; Rohm and Haas Company under the trade name Triton CF-21, and Union Carbide Corporation under the trade name Tergitol Min-Foam. These constituents in the aqueous solution will effectively convert, i.e. convert back into the nitrate salt and $CO_2$, carbonate impurities which are salts of sodium, potassium, magnesium, lithium, strontium and others normally present in the commercial salt bath from about 0.01 percent to about three percent by weight.

EXAMPLE II—REMOVAL OF CARBONATE IMPURITY BY PRECIPITATION AND FLOCCULATION

The removal of sodium carbonate from the rinse water in the partially concentrated bath of tank 14 can also be accomplished by precipitation. This process is preferably carried out in a separate container between the rinse tank 14 and the concentrator 22 such that the resulting precipitates neither interfere with the continuous operation of the heat treating plant nor collect on and foul the operation of various physical elements so as to require extraordinary maintenance thereof. In the following example it will be assumed that the steps of precipitation and flocculation are carried out in the surge tank 20.

The first step is to add a precipitant such as calcium nitrate to the partially concentrated rinse water salt/impurity solution. The resulting precipitate tends to be fairly fine and accordingly a flocculent such as a polyacrylamide is added. A suitable flocculent is available from the Hercules Chemical Company and is sold under the trade name Hercofloc. Once flocculated, the precipitate may be filtered in unit 26 by conventional mechanical means for elimination from the concentrate. Alternatively, the precipitate may be centrifuged or removed simply by allowing it to settle to the bottom of the surge tank 20 where it may be periodically removed.

EXAMPLE III—ELIMINATION OF CHLORIDE

Where a molten chloride bath is used to heat the ferrous parts prior to quench, as shown in the drawing, it is inevitable that chloride salts are dragged into the quench bath. After a time the chloride content exceeds the level of solubility in the quench bath and crystallizes out to form a sludge which must be periodically removed. Dissolved and undissolved chloride is carried out by the parts and carriers to the rinse tank 14 where it is dissolved in the rinse water along with the nitrate to be recovered. Eliminating the chloride content from the rinse water prevents recycling the chloride back to the quench bath 12 and lengthens the period between shutdowns for sludge removal.

Chloride removal is preferably accomplished by electrolysis in a cell between the concentrator 22 and the melter 30 where the 50% salt solution is found. In this instance, the surge tank 27 shall be taken to represent the electrolytic cell and is equipped with a positive metal anode and a graphite cathode both of which are immersed in the 50% salt solution.

Upon attachment of the anode and cathode to a suitable source of potential, the electrolytic action produces free hydrogen at the cathode, chlorine gas at the anode, and a conversion of the sodium chloride to sodium hydroxide. The addition of nitric acid converts the hydroxide to sodium nitrate. The electrolytically converted concentrate is then pumped into the melter 30 for final concentration and returned to the quench bath 12 in the molten state.

It will be understood that the invention has been described with reference to specific illustrative embodiments and that the foregoing description is not to be construed in a limiting sense.

The embodiments of the invention in which an exclusive property or privilege is claimed are defined as follows:

1. An automatic on-line method for reclaiming water soluble heat treating salts from a rinse bath into which the salts and water soluble impurities have been introduced by dragout from a molten salt heat treating bath for treating metallic articles comprising the steps of:

concentrating the salt bearing rinse water;

treating the concentrated salt bearing rinse water for the removal of impurities, further evaporating the water from the concentrate until a substantially anhydrous molten salt is obtained;

automatically sensing that the salt is in the substantially anhydrous molten state, and automatically returning the molten salt to the heat treating bath.

2. Method as defined in claim 1 wherein said salt is a nitrate salt and the impurities are chloride ions, the step of treating the concentrated salt bearing electrolytically converting the chloride ions to chlorine gas;

and reacting the concentrate with nitric acid to produce the original nitrate salt.

3. An automatic on-line method for reclaiming water soluble heat treating salts from a rinse bath into which the salts and water soluble carbonate impurities have been introduced by drag-out from a molten salt heat treating bath for treating metallic articles comprising the steps of:

transferring the salt/impurity rinse water to another tank;

adding a precipitant to the rinse water solution to form a carbonate precipitate;

separating the carbonate precipitate from the solution;

evaporation of the water from the solution to obtain a substantially anhydrous salt melt;

automatically sensing that the salt is in the substantially anhydrous molten state;

and, automatically returning the molten salt to the heat treating bath.

4. Method as defined in claim 3 wherein a flocculent is added concurrently with the precipitant.

5. Method as defined in claim 3 wherein the precipitant is a nitrate salt.

6. Method as defined in claim 5 wherein the precipitant is calcium nitrate.

7. An automatic on-line method for reclaiming water soluble heat treating salts from a rinse bath into which the salts and water soluble carbonate impurities have been introduced by drag-out from a molten salt heat treating bath for treating metallic articles comprising the steps of:

automatically transferring the salt/impurity bearing rinse water to a concentrator, said transfer being controlled by a concentration measuring device inserted in the rinse water;

evaporating the water from the rinse water to obtain a concentrated solution;

automatically pumping the concentrated solution to a surge tank, said transfer being controlled by a concentration measuring device immersed in the concentrator;

automatically pumping the concentrated solution from the surge tank to a melter, said transfer being controlled by a level indicating device in the melter;

evaporating the remainder of the water from the concentrated solution in the melter to obtain a substantially anhydrous molten salt;

automatically sensing when the salt becomes substantially anhydrous;

automatically starting a rectification and transfer sequence;

said rectification comprising the steps of:

adding an aqueous solution consisting essentially of about 0.1% to about 8% by weight free nitric acid, about 0.01% to about 5% by weight of a non-ionic surface active agent for deterring foaming and the balance water;

mixing the molten salt for a sufficient period of time to complete rectification; and, thereafter pumping the rectified molten salt back to the heat treating bath.

8. Method as defined in claim 7 wherein the concentration measuring device in the rinse water is a gravitometer.

9. Method as defined in claim 7 wherein the concentration measuring device in the rinse water is a refractive index indicator.

10. Method as defined in claim 7 wherein the sensor in the melter detects the substantially anhydrous state by measuring the temperature in the melter.

11. Method as defined in claim 7 wherein the sensor in the melter detects the substantially anhydrous state by measuring the specific gravity in the melter.

12. Method as defined in claim 7 wherein the sensor in the melter detects the substantially anhydrous state by sensing that the volume of the fluid in the melter has decreased an amount equivalent to the water originally therein.

13. An automatic on-line method for reclaiming water soluble heat treating salts from a rinse bath into which the salts and water soluble carbonate impurities have been introduced by drag-out from a molten salt heating treating bath for treating metallic articles comprising the steps of:

automatically transferring salt/impurity bearing rinse water to a surge tank, said transfer being controlled by a concentration measuring device inserted in the rinse water;

adding a precipitant to the rinse water solution to form a carbonate precipitate;

separating the carbonate precipitate from the solution;

transferring the carbonate free rinse water to a concentrator, said transfer being controlled by a level sensing device in the concentrator;

evaporating the water from the rinse water to obtain a concentrated solution;

automatically pumping the concentrated solution to a second surge tank, said transfer being controlled by a concentration measuring device immersed in the concentrator;

automatically pumping the concentrated solution from the surge tank to a melter, said transfer being controlled by a level indicating device in the melter;

evaporating the remainder of the water from the concentrated solution in the melter to obtain a substantially anhydrous molten salt;

automatically sensing when the salt becomes substantially anhydrous;

and pumping the molten salt back to the heat treating bath.

14. Method as defined in claim 13 wherein the concentration measuring device in the rinse water is a gravitometer.

15. Method as defined in claim 13 wherein the concentration measuring device in the rinse water is a refractive index indicator.

16. Method as defined in claim 13 wherein the sensor in the melter detects the substantially anhydrous state by measuring the temperature in the melter.

17. Method as defined in claim 13 wherein the sensor in the melter detects the substantially anhydrous state by measuring the specific gravity in the melter.

18. Method as defined in claim 13 wherein the sensor in the melter detects the substantially anhydrous state by sensing that the volume of the fluid in the melter has decreased an amount equivalent to the water originally therein.

* * * * *